United States Patent [19]

Kanzaka

[11] 4,023,241

[45] May 17, 1977

[54] TOP END CONSTRUCTION FOR SLIDE FASTENERS

[75] Inventor: Yoshihiro Kanzaka, Nyuzen, Japan

[73] Assignee: Yoshida Kogyo Kabushiki Kaisha, Japan

[22] Filed: Dec. 22, 1975

[21] Appl. No.: 642,995

[30] Foreign Application Priority Data

Dec. 28, 1974 Japan ..... 49-502264[U]

[52] U.S. Cl. ..... 24/205.11 F; 24/205.16 D

[51] Int. Cl.[2] ..... A44B 19/36; A44B 19/38

[58] Field of Search ..... 24/205.11 F, 205.11 R, 24/205.16 D

[56] References Cited

UNITED STATES PATENTS

| | | | |
|---|---|---|---|
| 2,177,599 | 10/1939 | Murphy | 24/205.11 R |
| 2,325,305 | 7/1943 | Carlile | 24/205.11 R |
| 2,575,502 | 11/1951 | Prupis | 24/205.11 R |
| 2,622,294 | 12/1952 | Legat | 24/205.11 R |
| 2,658,251 | 11/1953 | Simpson | 24/205.11 F |
| 3,081,462 | 3/1963 | Radousky | 24/205.11 R |

FOREIGN PATENTS OR APPLICATIONS

| | | | |
|---|---|---|---|
| 805,357 | 2/1969 | Canada | 24/205.11 F |
| 950,192 | 9/1949 | France | 24/205.11 R |
| 678,857 | 9/1952 | United Kingdom | 24/205.11 R |
| 875,033 | 8/1961 | United Kingdom | 24/205.11 F |

*Primary Examiner*—Bernard A. Gelak
*Attorney, Agent, or Firm*—Bucknam and Archer

[57] ABSTRACT

A slide fastener having at its top end a slider escape mechanism which comprises a cooperative pair of yieldable top stops, and an extra length of fastener elements carried on one of the stringer tapes, such that the slider can be forced past the yieldable top stops to ride onto the extra fastener elements in an emergency and hence to release the other stringer tape. To permit ready withdrawal of the said other stringer tape from the slider, a reinforcing sheet of thermoplastic material or the like is heat-sealed or otherwise attached to its upper end portion, from which at least the bead of the tape is removed. The fastener can be forced open from its top end without pulling the slider down along the rows of interlocking fastener elements.

1 Claim, 3 Drawing Figures

TOP END CONSTRUCTION FOR SLIDE FASTENERS

BACKGROUND OF THE INVENTION

This invention relates to slide fasteners, and more particularly to a slide fastener with a pair of stringers which are normally separated completely from each other by pulling a slider down along rows of interlocking fastener elements to a separable bottom end fitting on the stringers but which, in an emergency, can be readily separated from the top ends thereof without moving the slider to the bottom end fitting and hence without manipulating the latter. The emergency opening fastener of this character finds typical application on sleeping bags or tents.

In the slide fastener of the type under consideration, it has been common to remove the cord, which is stitched to each stringer tape to provide the usual edge bead, from an upper end portion of one of the tapes so that the upper end portion of the tape may be smoothly withdrawable from the slider in an emergency. It is, however, a rather difficult and time-consuming job to cut off only the cord from the tape without damaging the latter. Moreover, after removal of the cord from the upper end portion of the tape, there usually remain loose threads or yarns used for stitching the cord. Such loose threads, and possibly the threads that have revaled from the damaged zone of the tape, may be caught by the slider while the upper end portion of the tape is being withdrawn therefrom in an emergency, thereby preventing the smooth separation of the fastener stringers.

It has also been known to cover the beaded edge of the upper end portion of one of the stringer tapes with a sheet of thermoplastic material and then to flatten the edge with the thermoplastic sheet under application of heat and pressure. This measure has been resorted to particularly in the case where the edge bead of the tape is formed by a cord woven or knitted therein and is therefore not removable without damaging the tape. The tape edge thus flattened, however, is easy to regain the original thickness when moistened or by being repeatedly bent or folded in the use of the fastener, so that the tape is likely to become not easily withdrawable from the slider.

SUMMARY OF THE INVENTION

It is a principal object of this invention to provide, in an emergency opening slide fastener of the type defined, improved means for permitting ready withdrawal of one of the stringer tapes from the slider in an emergency, such that the noted difficulties of the prior art are thoroughly overcome.

With this and other objects in view, the present invention is directed to a slide fastener of the type comprising a pair of separable stringer tapes having opposed longitudinal edges beaded to carry rows of interlocking fastener elements which are progressively engaged and disengaged by a slider slidable therealong, and a slider escape mechanism including an extra length of fastener elements formed on the beaded edge of one of the stringer tapes as an upward extension of the regular row of fastener elements carried thereby, so that the slider can be guided onto the extra fastener elements in an emergency.

According to this invention, a reinforcing sheet of thermoplastic material or the like is substantially integrally attached to the other of the stringer tapes so as to cover its upper end portion in opposed relationship to the extra length of fastener elements on the said one stringer tape. At least the bead is removed from the upper end portion of the said other stringer tape, either before or after attachment of the reinforcing sheet, so that the slider when guided onto the extra length of fastener elements in an emergency, will readily release the upper end portion of the other stringer tape to permit the fastener stringers to be manually spread apart from their top ends.

This invention is equally applicable either when the edge bead to be removed is stitched to the stringer tape or when it is woven or knotted into the tape, without the difficulties pointed out previously. Furthermore, the upper end portion of the stringer tape according to the invention is easy to prepare because it can be formed merely by means for attaching the reinforcing sheet thereto and means for cutting off at least the bead therefrom.

The features which are considered characteristic of this invention are set forth in particular in the appended claim. The invention itself, however, both as to its construction and manner of functioning, together with the additional objects and advantages thereof, will become apparent in the course of the following description, which is to be read in connection with the accompanying drawings in which like reference characters refer to like parts throughout the several views.

DESCRIPTION OF THE PREFERRED EMBODIMENTS

Figure 1:
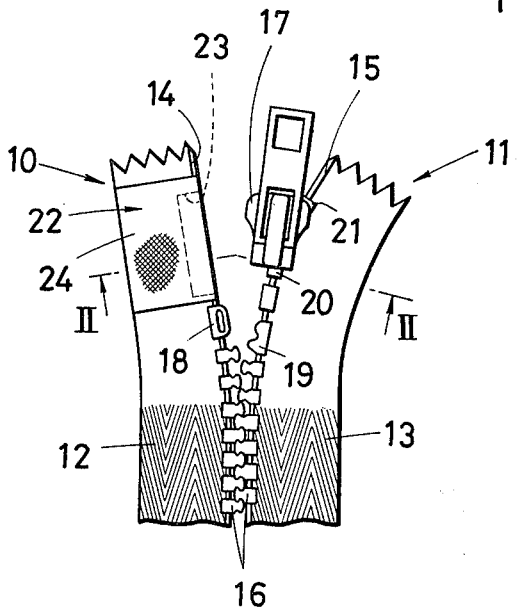
FIG. 1 is a fragmentary front view of an emergency opening slide fastener incorporating the improved means of the present invention.
Figure 2:
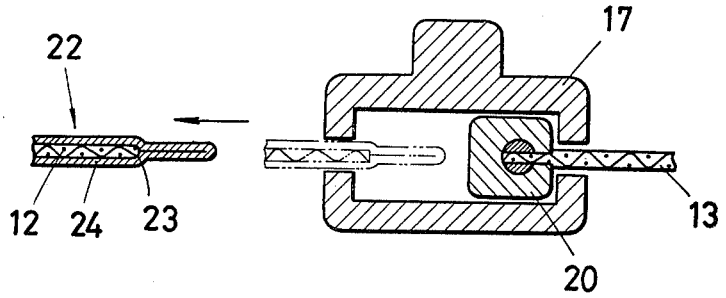
FIG. 2 is an enlarged fragmentary cross-section along line II—II of FIG. 1.

The invention will now be described in terms of its first preferred embodiment shown in FIGS. 1 and 2. With particular reference to FIG. 1, the illustrated slide fastener comprises a pair of separable stringers generally designated 10 and 11. These stringers comprise flexible stringer tapes 12 and 13 having their opposed longitudinal edges reinforced with beads 14 and 15 to carry rows of predeterminedly spaced, interlocking fastener elements 16. These fastener elements can be clamped or otherwise secured to the beaded edges of the stringer tapes 12 and 13 and are adapted to be progressively engaged and disengaged by a slider 17 slidable therealong to close and open the fastener. Although not shown in the drawings, a suitable separable bottom end fitting such as the conventional box-and-pin separable coupling may be provided at the bottom end of the fastener to separably connect the stringers 10 and 11.

The slide fastener of FIG. 1 is further provided with a slider escape mechanism comprising a cooperative pair of yieldable top stops 18 and 19 mounted on the respective rows of interlocking fastener elements 16 at their upper extremities, and an extra length of fastener elements 20 carried on the beaded edge of the stringer tape 13 as an upward extension of the regular row of fastener elements 16 thereon. The extra length of fastener elements 20 has a top stop 21.

Normally, the pair of yieldable top stops 18 and 19 is effective to limit the upward or fastener closing movement of the slider 17 along the rows of interlocking fastener elements 16. However, when the slider 17 is forcibly pulled upwardly from its closed position on the fastener stringers 10 and 11, as in an emergency, the top stops 18 and 19 jointly permit the slider to travel therepast and to ride onto the extra length of fastener elements 20 on the stringer tape 13.

The slider escape mechanism of the foregoing construction and operation is by itself conventional, being disclosed in U.S. patent application Ser. No. 623,261.

This invention is directed specifically to means 22 formed at an upper end portion of the stringer tape 12 in opposed relationship to the extra length of fastener elements 20 on the other stringer tape 13, in order that the stringer tape 12 may be readily released by the slider 17 when same is forcibly moved onto the extra length of fastener elements in an emergency.

According to the invention, the bead 14 and the adjacent edge portion of the stringer tape 12 are cut off from the aforesaid upper end portion of the tape, as indicated by the imaginary lines 23 in FIG. 1. The length of this cut-off portion 23 should be at least equal to, or preferably suitably longer than, the length of the body of the slider 17. A reinforcing sheet or film 24 of thermoplastic material is then wrapped around the upper end portion of the stringer tape 12 inclusive of its cut-off portion 23 and is heat-sealed thereto as by a suitable heater or by the conventional ultrasonic or high frequency method.

In the use of the slide fastener of FIG. 1, the slider 17 which has been in its closed position on the pair of stringers 10 and 11 may be forced upwardly past the pair of yieldable top stops 18 and 19 onto the extra length of fastener elements 20 on the stringer tape 13 in an emergency. As illustrated in FIG. 2, the reinforced upper end portion of the other stringer tape 12, having no edge bead 14, is then readily withdrawable from the slider 17 on the extra length of fastener elements 20. The stringers 10 and 11 of the fastener can then be completely spread apart from each other by disengaging the rows of fastener elements 16 without need for pulling the slider 17 down therealong.

Figure 3:
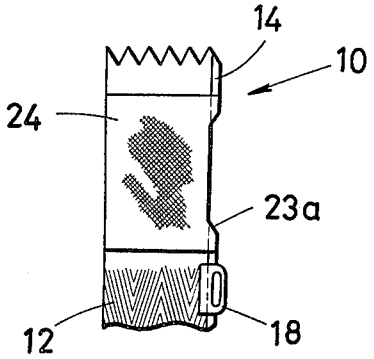
FIG. 3 is a fragmentary front view of another preferred embodiment of the invention.

FIG. 3 illustrates a modification of the preceding embodiment, in which the beaded edge of the upper end portion of the stringer tape 12 is cut off at 23*a* after attaching the reinforcing sheet or film 24 of thermoplastic material or the like thereto. Other details are exactly as set forth above in connection with FIGS. 1 and 2. The bead and, if desired, the adjacent edge portion of the stringer tape 12 can be removed from its upper end portion either before or after attachment of the reinforcing sheet thereto according to the invention.

Having thus described the invention, it is clear that the objects as stated above have been attained in a simple and practical manner. While some particular embodiments of this invention have been shown and described, it is to be understood that changes may be made in the construction and arrangement of the various parts without departing from the scope of the invention.

What is claimed is:

1. In a slide fastener including a pair of separable stringer tapes each having a bead on one of its longitudinal edges to carry a row of interlocking fastener elements thereon, a slider movable along the rows of interlocking fastener elements for progressively engaging and disengaging the fastener elements to open and close the fastener, and a slider escape mechanism arranged at the upper end of one of the stringer tapes and including an extra length of fastener elements carried on the beaded edge of said one of the stringer tapes, said slider escape mechanism being adapted to permit the slider to ride onto the extra length of fastener elements as desired; the combination thereof with slider release aiding means formed at an upper end portion of the other of the stringer tapes in opposed relationship to the extra length of fastener elements on said one stringer tape, said release aiding means comprising edge means defining a cut-off portion of the bead which is cut off together with the adjacent edge portion of the stringer tape from said upper end portion of said tape; and a reinforcing sheet substantially integrally covering said upper end portion of said other stringer tape, whereby said upper end portion of said other stringer tape is of a thickness less than said bead and thereby readily withdrawable from the slider when same is riding on the extra length of fastener elements on said one stringer tape.

* * * * *